7/7/87 OR 4,678,964

United States Patent [19]

Peels

[11] Patent Number: 4,678,964

[45] Date of Patent: Jul. 7, 1987

[54] COLOR DISPLAY TUBE

[75] Inventor: Antonius H. P. M. Peels, Eindhoven, Netherlands

[73] Assignee: U.S. Philips Corporation, New York, N.Y.

[21] Appl. No.: 821,113

[22] Filed: Jan. 17, 1986

Related U.S. Application Data

[63] Continuation of Ser. No. 516,016, Jul. 22, 1983, abandoned.

[30] Foreign Application Priority Data

Aug. 25, 1982 [NL] Netherlands ..... 8203322

[51] Int. Cl.[4] ..... H01J 29/51; H01J 29/62

[52] U.S. Cl. ..... 313/414; 313/460

[58] Field of Search ..... 313/413, 414, 417, 449, 313/460

[56] References Cited

U.S. PATENT DOCUMENTS

| | | | |
|---|---|---|---|
| 4,406,970 | 9/1983 | Hughes | 313/414 |
| 4,535,266 | 8/1985 | Say | 313/414 |
| 4,581,560 | 4/1986 | Shirai et al. | 313/414 |
| 4,584,500 | 4/1986 | Day | 313/414 |

FOREIGN PATENT DOCUMENTS

| | | | |
|---|---|---|---|
| 56-30239 | 3/1981 | Japan | 313/414 |
| 58-64740 | 4/1983 | Japan | 313/414 |
| 2085649 | 4/1982 | United Kingdom | 313/413 |

OTHER PUBLICATIONS

Webster's New Collegiate Dictionary; 1960, G & C Merriam Co.; p. 267.

*Primary Examiner*—Palmer C. DeMeo
*Assistant Examiner*—Sandra L. O'Shea
*Attorney, Agent, or Firm*—Robert J. Kraus

[57] ABSTRACT

A field correction element (30) is provided in the peripheral field of a focusing lens of an electron gun system of a color display tube to reduce the potential differences between the electrodes of the focusing lens necessary for horizontal and vertical focusing, respectively. The field correction element (30) consists of a plate (31) which extends substantially perpendicularly to the electron beams and has elongate or square apertures (32, 33, 34) through which the electron beams (6, 7, 8) pass. It is also possible to perform convergence corrections by means of such a field correction element.

6 Claims, 14 Drawing Figures

COLOR DISPLAY TUBE

This is a continuation of application Ser. No. 516,016, filed July 22, 1983, now abandoned.

BACKGROUND OF THE INVENTION

The invention relates to a colour display tube comprising an envelope consisting of a neck, a cone and a display window, and in the neck having an integrated electron gun system of the "in-line" type to generate three electron beams situated substantially with their axes in one plane. The electron gun system comprises successively a cathode, a grid and an anode to generate each electron beam and at least two electrodes for focusing each electron beam on the display screen which is provided on the display window. The electrodes, which are common to the three electron beams, produce an electric field which forms focusing lenses for the electron beams when a suitable potential difference is applied. The electrodes each include a cup-shaped part, the bottom of which has three apertures through which the electron beams pass.

Such a colour display tube is known from Netherlands Patent Application No. 7904114 laid open to public inspection, corresponding to U.S. Pat. No. 4,337,409. The three electron beams can be focused to form spots on the display screen by focusing lenses of the bipotential type consisting of two electrodes which are at different potentials. However, it is also possible to use focusing lenses of the unipotential type consisting of three electrodes, the first and the last electrode of which have the same potentials. It is also possible to focus with four successive electrodes which can be electrically interconnected in different manners. An embodiment of this latter type is described in Applicants' Netherlands Patent Application No. 8102526 not yet laid open to public inspection, corresponding to U.S. patent application Ser. No. 370,430 filed Apr. 21, 1982. The electrodes of all the above-described lens types in integrated electron gun systems each consist of at least one cup-shaped part the bottom of which has three apertures through which the electron beams pass. A collar is usually provided around each of the apertures and extends into the cup-shaped part, usually parallel to the cup wall.

The disadvantage of such so far used electron gun systems is that often as a result of astigmatism in the focused electron beams parts of the displayed picture are not sharp. This astigmatism occurs substantially due to the lack of competely circular symmetry of the apertures and collars. The circular symmetry is lacking because of defects occurring during the manufacture of the electrodes. During the manufacture and assembly of the gun components, errors may also be introduced which cause the location of the three spots of the three electron beams on the display screen to be incorrect.

SUMMARY OF THE INVENTION

It is therefore an object of the invention to provide means to reduce the astigmatism in the electron beams and to thus obtain a colour display tube having a sharper picture than with the so far used display tubes. Another object of the invention is to provide means with which eletron gun systems can be corrected after assembly, with respect to astigmatism and convergence of the electron beams.

For that purpose, a colour display tube of the kind mentioned in the opening paragraph is characterized according to the invention in that a field correction element for correcting the focusing lenses is provided in at least one of the cup-shaped parts. The correction element comprises a substantially plate-shaped part extending substantially parallel to the bottom of the cup-shpaed part and having elongate or square apertures through which the electron beams pass.

One indication of the strength of the astigmatism is the difference $\Delta V_{foc}$ between the potential difference necessary to focus with the lens electrodes in a horizontal direction and the potential difference necessary to focus with the lens electrodes in a vertical direction. This difference ($\Delta V_{foc}$) between these two potential differences may not be too large and should preferably be between minus 100 and plus 200 volts. Too large a positive deviation from this difference gives rise to a large vertical spot in the centre of the display screen. Too large a negative deviation from this difference gives rise to a spot having a vertical haze in the centre and an even stronger vertical haze in the corner of the display screen.

Dependent on the intensity and the nature of the astigmatism the elongate apertures in the field correction element may extend with their longitudinal axis in a horizontal or vertical direction and may be more or less elongate. In designing an electron gun system, the field correction element may be used to keep the astigmatism of each system within certain limits. However, it is also possible to determine the average static convergence and/or astigmatism error of a large group of electron gun systems manufactured immediately after each other by taking tests, after which the static convergence and/or the astigmatism of the group can afterwards be reduced to an acceptable value by means of a field correction element. The spreading of the mechanical errors within such a group is not large.

A preferred embodiment of a colour display tube according to the invention is characterized in that the apertures in the bottom of the cup-shaped part comprise collars extending inwardly and substantially parallel to the cup wall, and the field correction element is provided against or substantially against the collars. By providing the collars, inter alia fewer high voltage problems occur. The distance between the field correction element and the ends of the collars extending in the cup-shaped part may not be too large because the field correction element must still be present in the field of the focusing lens. The elongate apertures in the field correction element may be rectangular or oval.

When the field correction element is also cup-shaped and is provided coaxially in the cup-shaped part of one of the electrodes, of which cup-shaped field correction element the bottom forms the plate-shaped part, a simple assembly of the field correction element is possible.

When the field correction element, viewed in the direction of propagation of the electron beams, is provided in the cup-shaped part of the last electrode of the electron gun system, the field correction element may be provided after the assembly of the gun.

When the cup-shaped field correction element at its edge comprises a radially extending flange, the field correction element may be added without special measures to existing electron gun systems.

When the apertures in the field correction element through which the outermost beams pass are shifted radially with respect to the beam axes, it is possible to influence the location of the spots of the three electron beams on the display screen relative to each other. For example, it is possible to perform convergence corrections simultaneously with astigmatism corrections by means of the field correction element.

It is possible to provide such a correction element in more than one of the electrodes.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
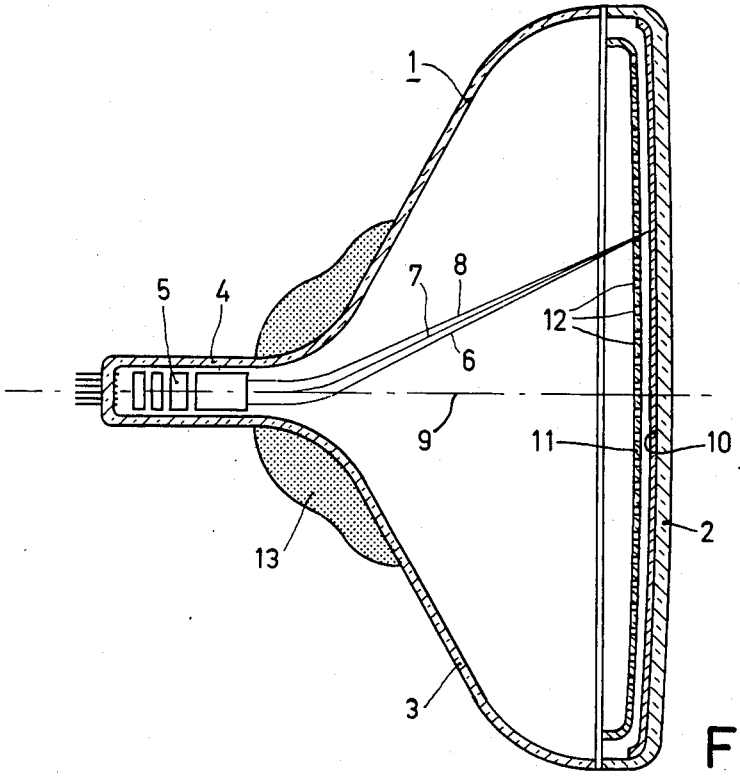
FIG. 1 is a longitudinal sectional view of a colour display tube according to the invention.

FIG. 1 is a longitudinal sectional view of a colour display tube of the "in-line" type. An integrated electron gun system 5 which generates three electron beams 6, 7 and 8 which are situated with their axes in the plane of the drawing is provided in the neck of a glass envelope 1 which is composed of a display window 2, a cone 3, and a neck 4. The axis of the central electron beam 7 initially coincides with the tube axis 9. The display window 2 comprises on its inside a large number of triplets of phosphor lines. Each triplet comprises a line consisting of a blue-luminescing phosphor, a line consisting of a green-luminescing phosphor, and a line consisting of a red-luminescing phosphor. All triplets together constitute the display screen 10. The phosphor lines extend perpendicularly to the plane of the drawing. A shadow mask 11 is provided in front of the display screen and comprises a large number of elongate apertures 12 through which the electron beams 6, 7 and 8 pass each impinging only on phosphor lines of one colour. The three electron beams situated in one plane are deflected by the system 13 of deflection coils.

Figure 2:
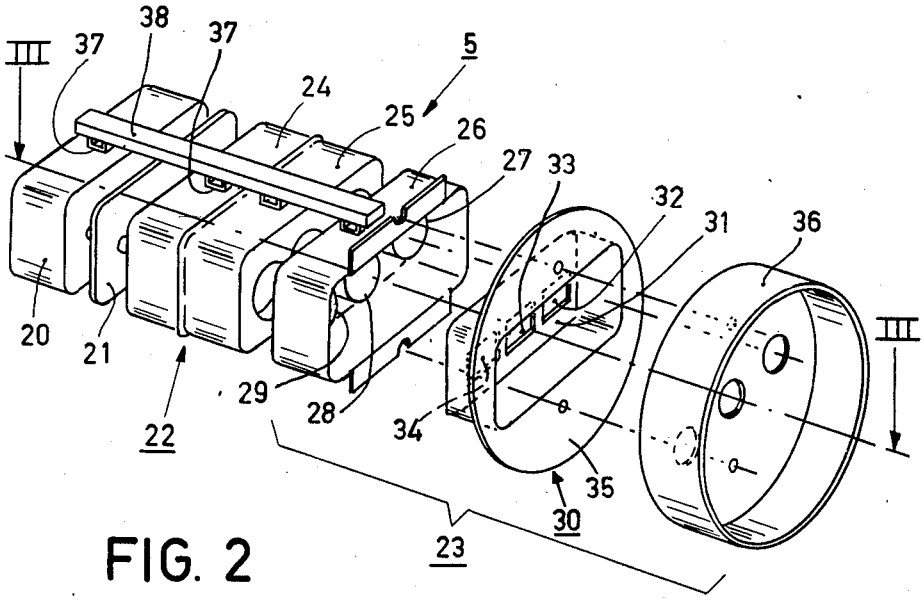
FIG. 2 is a perspective exploded view of an embodiment of an electron gun system as used in the tube of FIG. 1.

FIG. 2 is a perspective exploded view of an embodiment of an electron gun system as used in the colour display tube shown in FIG. 1. The electron gun system comprises a common cup-shaped control electrode 20 in which three cathodes (not visible) are connected, and a common plate-shaped anode 21. The three electron beams situated with their axes in one plane are focused by means of electrode 22 and electrode 23 which are common to the three electron beams. Electrode 22 consists of two cup-shaped parts 24 and 25 which are secured together at their open ends. Electrode 23 comprises one cup-shaped part 26 the bottom of which has three apertures which are provided with three collars 27, 28 and 29. Electrode 23 additionally comprises a field correction element 30 which is also cup-shaped and which comprises a plate-shaped part 31 having rectangular apertures 32, 33, 34.

In the assembled condition of the electron gun system the rectangular-apertures in the plate-shaped part 31 are situated against or substantially against the ends of the collars 27, 28 and 29. The field correction element 30 has a flange 35 for the connection between the cup-shaped part 26 and the centering sleeve 36 which is used for centering the electron gun system in the tube neck. It will be obvious that it is possible to connect such a field correction element (without a flange 35) in part 25 of the cup-shaped electrode 22. Corrections of the electron lenses generated between the electrodes 22 and 23 are then also possible. The electrodes of the electron gun system are connected to glass rods 38 by means of braces 37. As shown in this Figure it is possible to provide the field correction element 30 after assembly of the electron gun system. The shape and location of the elongate or square apertures in the field correction element may then be chosen after the average astigmatism and convergence errors of a group of electron gun systems have been fixed.

Figure 3:
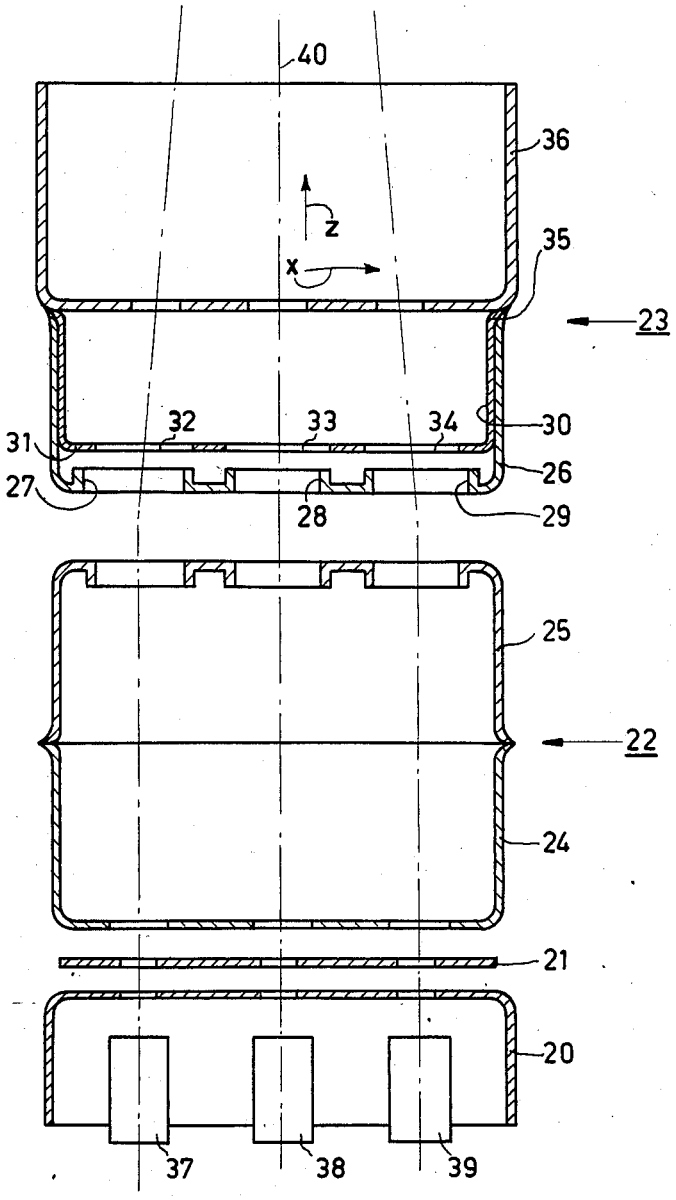
FIG. 3 is a longitudinal sectional view of an electron gun system according to FIG. 2.

FIG. 3 is a longitudinal sectional view of the electron gun system shown in FIG. 2. The reference numerals correspond to those of FIG. 2. Three cathodes 37, 38 and 39 for generating the three electron beams are provided in the control electrode 20. Axis 40 of the central electron gun of the electron gun system coincides with the tube axis 9 (see FIG. 1).

Figure 4A:
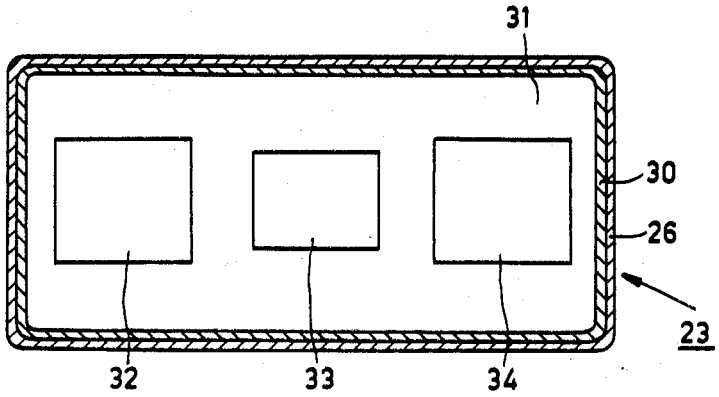
FIG. 4*a* is a cross-sectional view through lens electrode component 26 of FIG. 3.

FIG. 4*a* is a cross-sectional view of lens electrode component 26 of FIG. 3. A cup-shaped field correction element 30 having a plate-shaped bottom 31 is provided in the cup-shaped part 26 of electrode 23. This bottom has three rectangular apertures 32, 33 and 34. The long rectangular sides of the apertures are parallel to the plane through the beam axes (the plane of the drawing of FIG. 3).

Figure 4B:
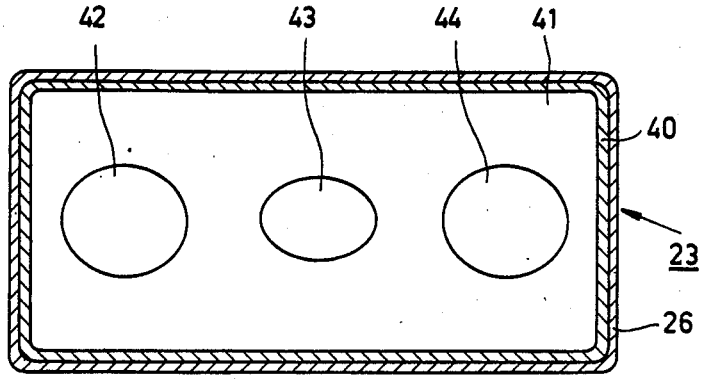
FIG. 4*b* shows an alternative of the embodiment shown in FIG. 4*a*, FIGS. 5*a* to 5*f* show the operation of the field correction element with reference to a number of equipotential line presentations.

FIG. 4*b* shows an alternative embodiment of the correction element shown in FIG. 4*a*. A cup-shaped field correction element 40 having a plate-shaped bottom 41 is provided in the cup-shaped part 26 of electrode 23. The bottom has three oval apertures 42, 43 and 44. The long axes of oval apertures are parallel to the plane through the beam axes.

The long rectangular sides of the rectangular apertures of FIG. 4*a* or the long axes of the oval aperture of FIG. 4*b* may also extend perpendicularly to the plane through the beam axes, dependent on the errors to be corrected.

It is also possible to make one or more of the apertures oval and the remaining apertures rectangular. The corners of the rectangular apertures may also be rounded off.

The operation of the field correction element will be illustrated with reference to FIGS. 5*a* to 5*f*.

Figure 5A:
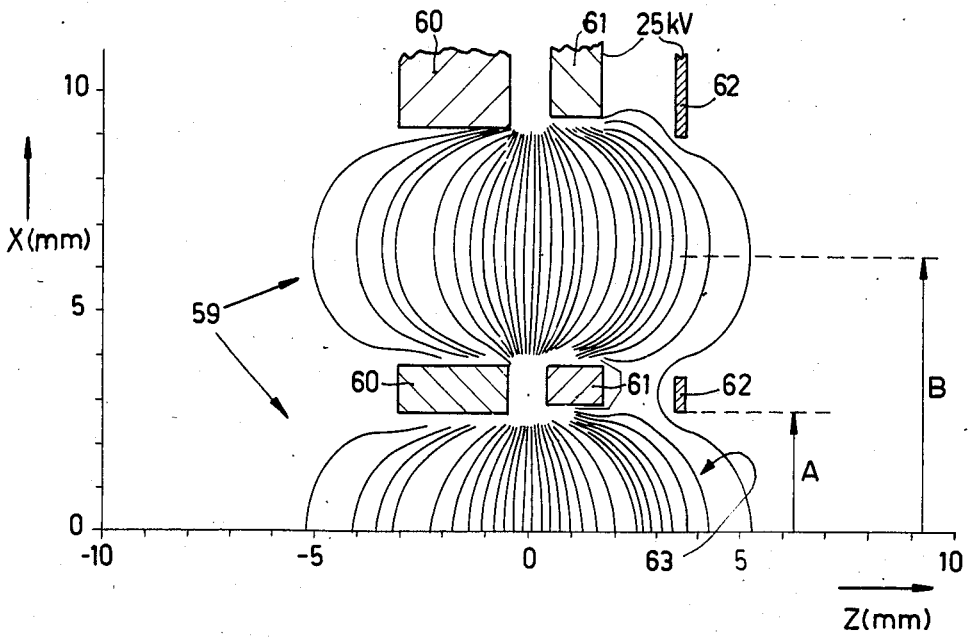
Figure 5B:
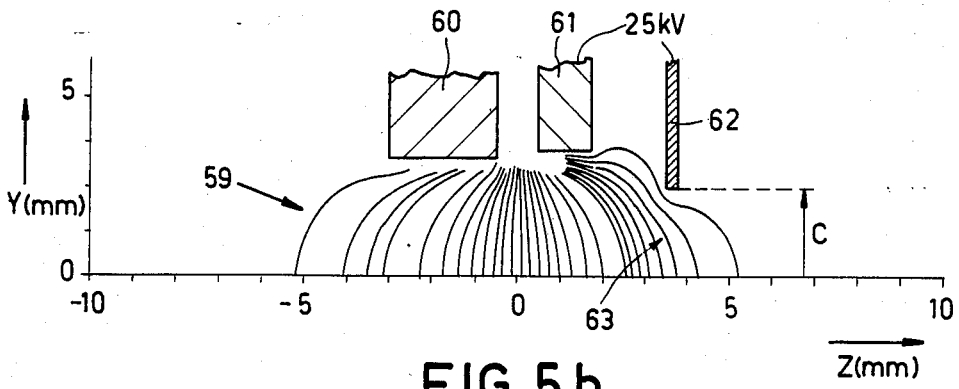

FIG. 5*a* shows a number of equipotential lines 59 between two focusing electrodes 60 and 61 which are influenced by a field correction element 62, which equipotential lines are situated in a horizontal plane through the beam axes. The axis of the central electron beam coincides with the tube axes and in this Figure is the z-axis. The x-axis extends in the plane and is perpendicular to the z-axis. The field correction element comprises a rectangular aperture 63 having a width 2A of 5.5 mm. FIG. 5*b* shows a number of equipotential lines between the two electrodes 60 and 61 but this time in a vertical plane through the central beam axis and perpendicular to the horizontal plane through the beam axes. Because equipotential lines are symmetrical with respect to the z-axis, only the variation of the equipotential lines on one side of the z-axis is shown. The height 2C of the rectangular aperture 63 in the field correction element 62 is 4 mm. The dimensions of apertures and distances between electrodes can be determined by means of the x, y and z-axes alongside which the distances in mm are plotted.

Figure 5C:
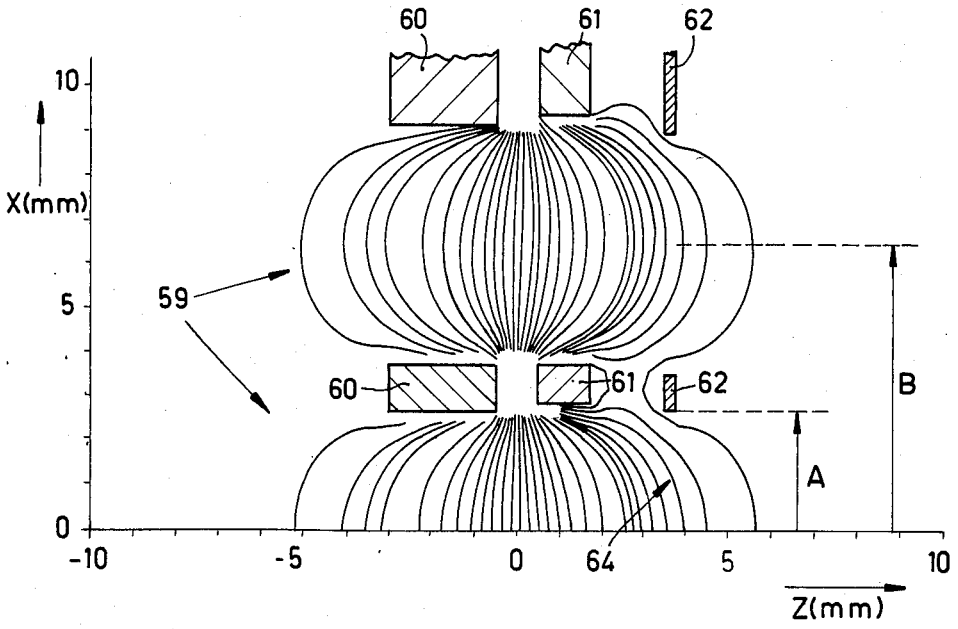
Figure 5D:
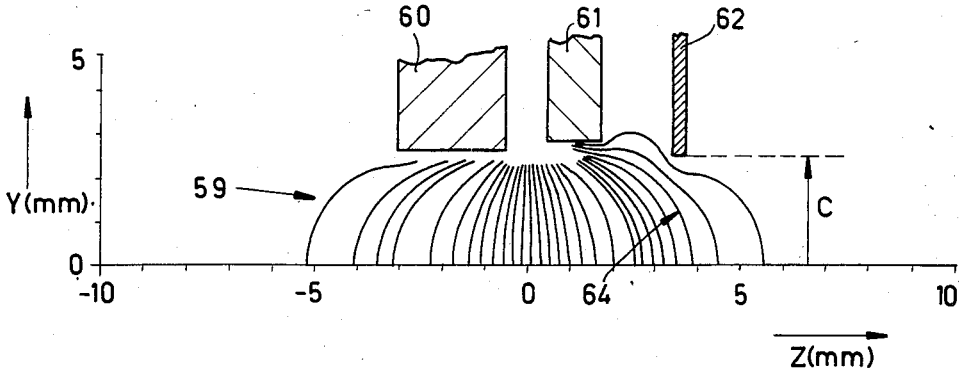

FIGS. 5*c* and 5*d* show analogous equipotential lines presentations as in FIGS. 5*a* and 5*b*. The height 2C of the aperture 64 now is 5.0 mm, however. The width 2A is again 5.5 mm.

Figure 5E:
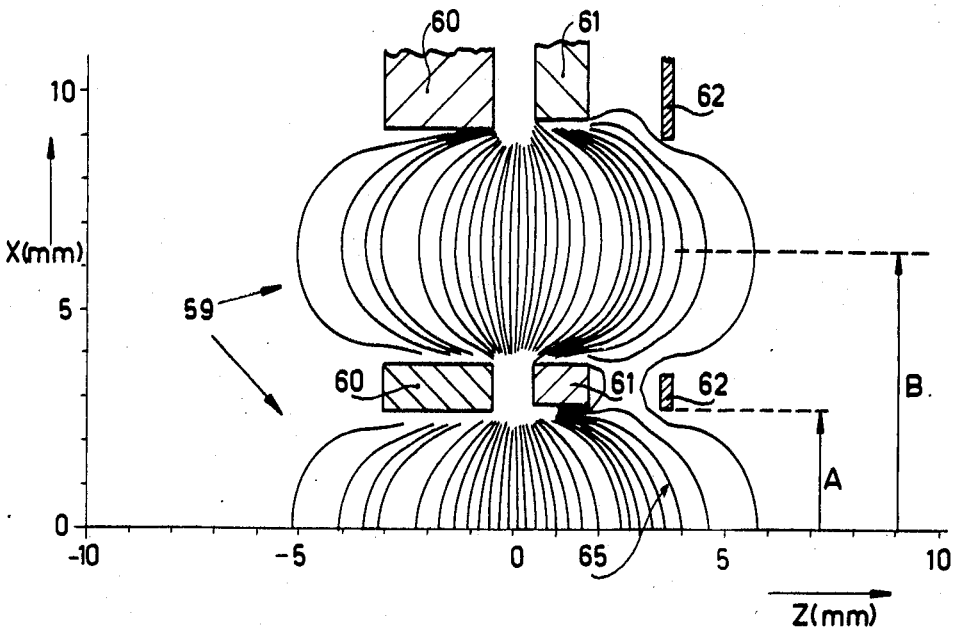
Figure 5F:
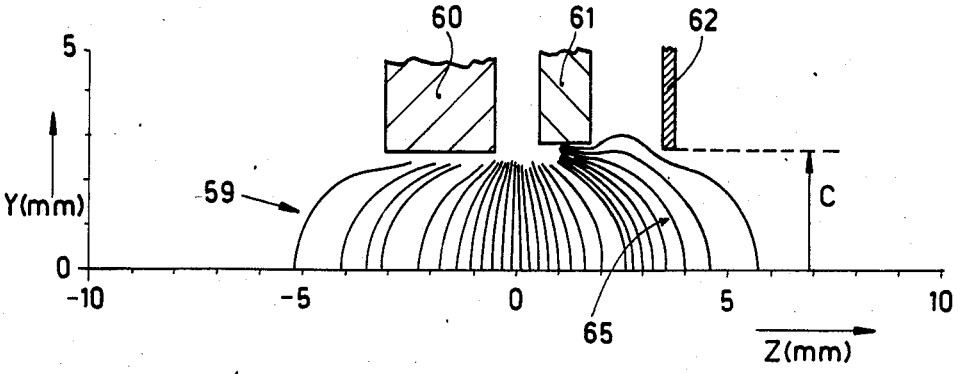

FIGS. 5*e* and 5*f* also show analogous equipotential lines presentations as in FIGS. 5*a* and 5*b*. The height 2C of the aperture 65 in this case is 5.5 mm. Because the width 2A is again 5.5 mm, aperture 65 is square.

The potential of electrode 61 and the correction element 62 connected thereto electrically and mechanically is always 25 kV in all the situations shown in FIGS. 5*a* to 5*f*. The distance B between the centers of the central aperture and of the side aperture is 6.3 mm.

When comparing the variation of the equipotential lines in FIGS. 5*a* to 5*f* it is striking that in electrode 60 the variation does not vary noticeably. The variation does change in and near the field correction element 62 and electrode 61. In this electrode and the field correction element the equipotential lines in FIG. 5*c* are more strongly curved than in FIG. 5*a*, and in FIG. 5*e* they are again more strongly curved than in FIG. 5*c*. In this electrode the equipotential lines in FIG. 5*d* are less strongly curved than in FIG. 5*b*, and in FIG. 5*f* they are again less strongly curved than in FIG. 5*d*. The part of the focusing lens in electrode 61 is a negative lens part. A strong curvature of the equipotential lines means a stronger lens action and a weaker curvature means a weaker lens action. It follows from FIGS. 5*a* to 5*f* that when the height 2C of the aperture in the field correction element is made larger with a constant width (5.5 mm), the negative lens part becomes stronger in the horizontal direction and becomes weaker in the vertical direction. The total lens action thus becomes weaker in the horizontal direction and becomes stronger in the vertical direction.

Nevertheless in order to be able to focus horizontally at 25 kV on electrode 61, the voltage at electrode 60 in that case must become lower, and in order to be able to focus vertically the voltage at electrode 60 must become higher. This also follows from the table below in which the potentials $V_{foc}$ on electrode 60 for FIGS. 5*a* to 5*f* are recorded which are necessary to be able to focus. In addition, the width (2×A) and the height (2×C) of the apertures in the field correction element are recorded. The potential difference $\Delta V_{foc}$ is also indicated which denotes the difference between the horizontal and vertical focusing potentials.

| No. Figure | Width 2 × A (mm) | Height 2 × C (mm.) | $V_{foc}$(v) Horizontal | $V_{foc}$(v) Vertical | $\Delta V_{foc}(V)$ |
|---|---|---|---|---|---|
| 5a | 5.5 | | 4992 | | 327 |
| 5b | | 4.0 | | 4665 | |
| 5c | 5.5 | | 4832 | | 34 |
| 5d | | 5.0 | | 4798 | |
| 5e | 5.5 | | 4788 | | −50 |
| 5f | | 5.5 | | 4838 | |

From the above it follows that $\Delta V_{foc}$ can be varied by means of a field correction element according to the invention. This may be done to a different extent for the central electron beam and for the side beam.

Figure 6:
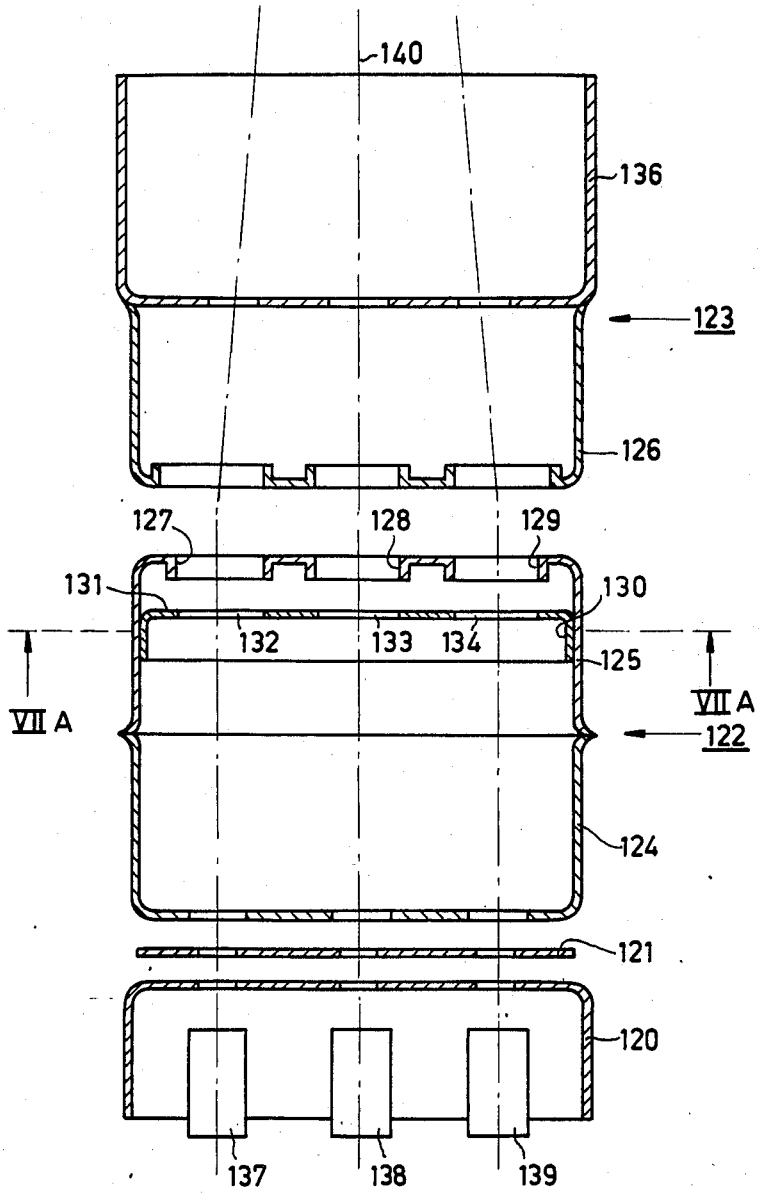
FIG. 6 is a longitudinal sectional view through another embodiment of an electron gun system having a field correction element.

FIG. 6 is a longitudinal sectional view of another embodiment of an electron gun system. Three cathodes 137,138 and 139 for generating three electron beams are provided in the common cup-shaped control electrode 120. Opposite to the control electrode 120 is present the plate-shaped anode 121 which is succeeded by a first focusing electrode 122 and a second focusing electrode 123. Electrode 122 consists of two cup-shaped parts 124 and 125 which are connected together at their open ends. Electrode 123 comprises one cup-shaped part 126 and a centering sleeve 136. The cup-shaped part 125 has three apertures with collars 127, 128 and 129. The field correction element 130 is provided in the cup-shaped part 125, is also cup-shaped, and has a plate-shaped part 131 with rectangular apertures 132, 133, 134. The long axes of the rectangular apertures in this case are perpendicular to the plane of the drawing.

Figure 7A:
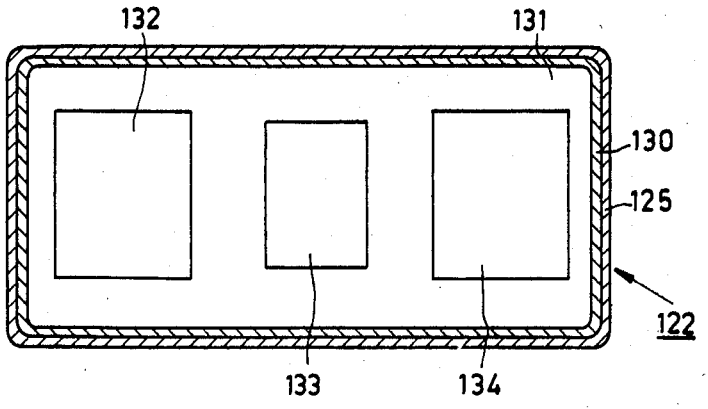
FIG. 7*a* is a cross-sectional view through lens electrode component 125 of FIG. 6.

FIG. 7*a* is a cross-sectional view through lens electrode component 125 of FIG. 6. A cup-shaped field correction element 130 having a plate-shaped bottom 131 is provided in the cup-shaped part 125 of electrode 121. The bottom comprises three rectangular apertures 132, 133, 134. The long rectangular sides of the apertures are perpendicular to the plane through the beam axes.

Figure 7B:
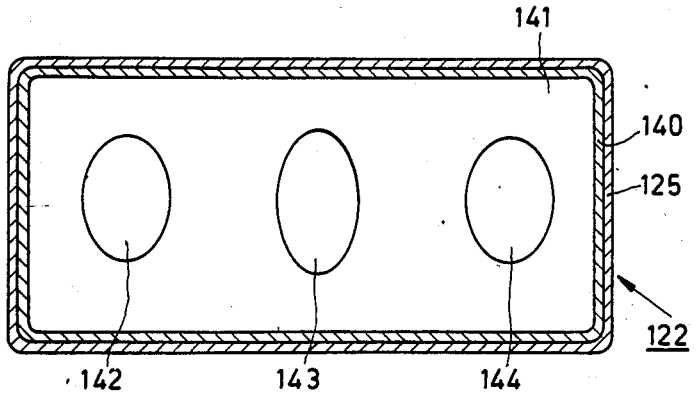
FIG. 7*b* is an alternative of the embodiment shown in FIG. 7*a*.

FIG. 7*b* shows an alternative embodiment of the correction element shown in FIG. 7*a*. A cup-shaped field correction element 140 having a plate-shaped bottom 141 is provided in the cup-shaped part 125 of electrode 122. The bottom comprises three oval apertures 142, 143, 144. The long axes of the oval apertures are perpendicular to the plane through the beam axes. It is possible to simultaneously use both the field correction element shown in FIG. 3 and the one shown in FIG. 6. The centers of the apertures in the field correction element shown in FIG. 3 may also be shifted from the beam axes so that convergence corrections are carried out. The location and dimensions of the apertures in the plate-shaped part of the field correction element may be established experimentally for any electron gun or can be calculated. The use of one or more field correction elements is, of course, also possible in electron gun systems having focusing lenses consisting of more than two electrodes.

What is claimed is:

1. In a color display tube comprising an evacuated envelope containing a luminescent screen and an electron gun system for producing a central electron beam and first and second outer electron beams lying in a single plane, said electron gun system including first and second spaced-apart cup-shaped focusing lens electrodes having respective first and second facing bottom plates, each plate including central and first and second outer apertures through which the corresponding electron beams pass, said electrodes cooperating to produce respective central and first and second outer focusing lenses for individually focusing the corresponding electron beams;

the combination with at least one of said electrodes of correction means for correcting astigmatic focusing and misconvergence of the electron beams, said correction means comprising a correction plate disposed within the respective cup-shaped electrode and parallel to its apertured bottom plate, said correction plate including central and first and second outer apertures through which the respective electron beams pass, at least one of said apertures begin elongate and having an individual height and width selected relative to each other to correct for astigmatic focusing of the respective electron beam, said outer apertures being located relative to said central aperture to correct for misconvergence of the electron beams.

2. A color display tube as in claim 1 where the apertures in the bottom plate of the cup-shaped electrode containing the correction plate are each surrounded by an inwardly-extending collar, and where the correction plate is positioned substantially against said collars.

3. A color display tube as in claim 1 or 2 where the at least one elongate aperture in the correction plate is substantially rectangular.

4. A color display tube as in claim 1 or 2 where the at least one elongate aperture in the correction plate is substantially oval.

5. A color display tube as in claim 1 or 2 where the correction plate forms a bottom part of a cup-shaped correction element which is disposed coaxially within the respective cup-shaped electrode.

6. A color display tube as in claim 5 where the electrode in which the correction plate is disposed is the last electrode of the electron gun system through which the electron beams pass.

* * * * *